United States Patent [19]

Jaton

[11] Patent Number: 4,844,436

[45] Date of Patent: Jul. 4, 1989

[54] DEVICE FOR FEEDING SHEETS INTO A PROCESSING MACHINE

[75] Inventor: Jean-Philippe Jaton, Val D'Illiez, Switzerland

[73] Assignee: Bobst SA, Switzerland

[21] Appl. No.: 178,364

[22] Filed: Apr. 6, 1988

[30] Foreign Application Priority Data

Apr. 10, 1987 [CH] Switzerland ..... 01405/87

[51] Int. Cl.[4] ..... B65H 3/04

[52] U.S. Cl. ..... 271/34; 271/3; 271/35; 271/8.1

[58] Field of Search ..... 271/3, 3.1, 4–7, 271/10–11, 35, 34, 124, 125, 131, 69, 306, 198, 116, 94, 8.1; 414/129, 130

[56] References Cited

U.S. PATENT DOCUMENTS

| | | | |
|---|---|---|---|
| 3,907,278 | 9/1975 | Jaton | 271/94 |
| 4,222,313 | 9/1980 | Staufner | 271/35 X |
| 4,555,103 | 11/1985 | Larson | 271/35 |
| 4,610,533 | 9/1986 | Takahata | 271/6 X |
| 4,619,571 | 10/1986 | Peiffer | 414/130 |

*Primary Examiner*—Douglas C. Butler

*Attorney, Agent, or Firm*—Hill, Van Santen, Steadman & Simpson

[57] ABSTRACT

A device for feeding blanks from a pile into an infeed arrangement for a blank processing machine, such as a folder or gluer, characterized by a frame having a plurality of conveyor units with an arrangement for laterally positioning the units in the frame depending on the width of the blank being processed, an arrangement for driving each of the units utilizing a single drive shaft and an arrangement for driving each of the conveyor units for a selected period of time during each feed cycle.

4 Claims, 12 Drawing Sheets

DEVICE FOR FEEDING SHEETS INTO A PROCESSING MACHINE

BACKGROUND OF THE INVENTION

The present invention is directed to a device for feeding sheets or blanks into a processing machine, which is designed for converting the sheet or blank into a product, for example, a folding and gluing machine.

A feeding device is already known, which has a front stop and a conveying arrangement for feeding the bottom sheet of a pile underneath the front stop into a folder gluer, which operation is to be determined by a controllable rhythm. Such a device is described in detail in U.S. Pat. No. 3,907,278, whose disclosure is incorporated by reference thereto. In the patent, the sheet infeed arrangement consists of a transmission pulley provided with a unidirectional coupling which enables the driving of the conveyor belts in one direction only. The necessary drive occurs from a control shaft actuated intermittently by a connecting rod-and-crankshaft arrangement.

The device of the patent, however, has a serious drawback in that the stroke required by the sheet to be fed cannot be adapted to the particular length of the sheet. Thus, the device results in an inadequate shift for the infeed control.

In fact, if such a device is used, the sheet is moved forward through a distance corresponding to the conveyor belt movement caused by the connecting rod and crankshaft arrangement until the sheet will be nipped by the drive rollers which are actually in charge of terminating the infeed movement. The sheet infeed action is, thus, carried out in two consecutive steps by two interacting appliances, which can jeopardize a reliable control of the advance for the sheet during the step of being fed into the processing machine.

SUMMARY OF THE INVENTION

The present invention is directed to overcome the above-mentioned drawbacks and its objects are achieved by allowing the feed of sheets into a sheet converting or processing machine by an improvement in the device designed for feeding sheets into a processing machine, said device having a frame, means for mounting one or more conveyor devices or units which includes at least one endless belt, a front stop for positioning a pile on the belt, said belt taking the bottommost sheet of the pile beneath the front stop in the direction of feed. The improvement comprises the conveyor means including single drive means for driving the continuous belt of each conveyor unit, control means for sequentially operating the drive means, and said mounting means adjustably mounting the conveyor units in selected lateral positions in a direction transverse to the direction of movement of the sheets through the device.

The benefits obtained from this invention consist essentially in that the infeed of the sheets into the folder-gluer is achieved without any slipping on the belts of the conveyor device. Moreover, the user has the possibility to adapt the forward movement of the belts of the conveyor device as required by the actual length of the sheets or blanks to be fed, which provides the operator with the possibility of determining at will the interval between two consecutive sheets. This will provide the advantage of increased efficiency in the use of the folder-gluer and assures the sequential infeed of the sheets with a high accuracy.

Other features and advantages of the present invention will be readily apparent from the following description of the preferred embodiments, the drawings and claims.

DESCRIPTION OF THE PREFERRED EMBODIMENTS

Figure 1:
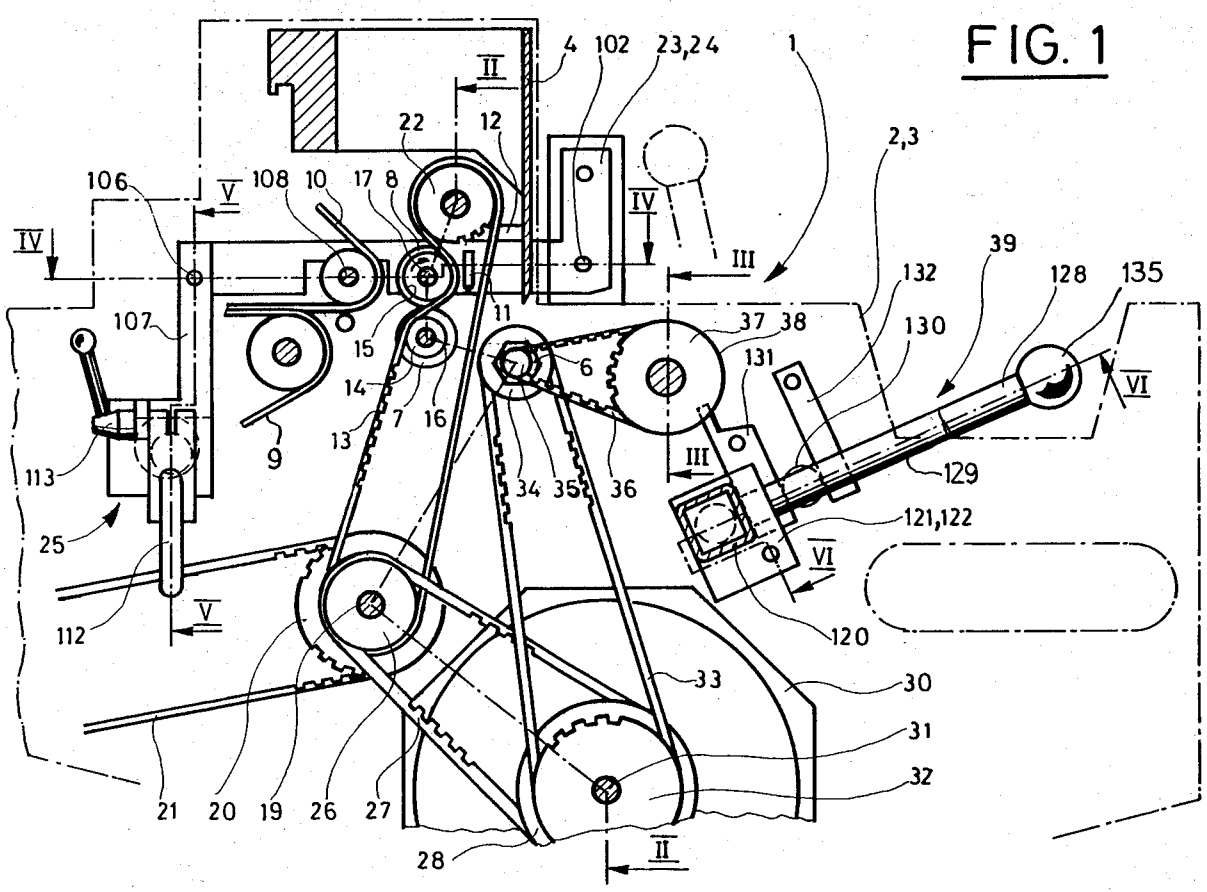
FIG. 1 is a schematic side view, with portions broken away for purposes of illustration, of the infeed device of the present invention.
Figure 2:
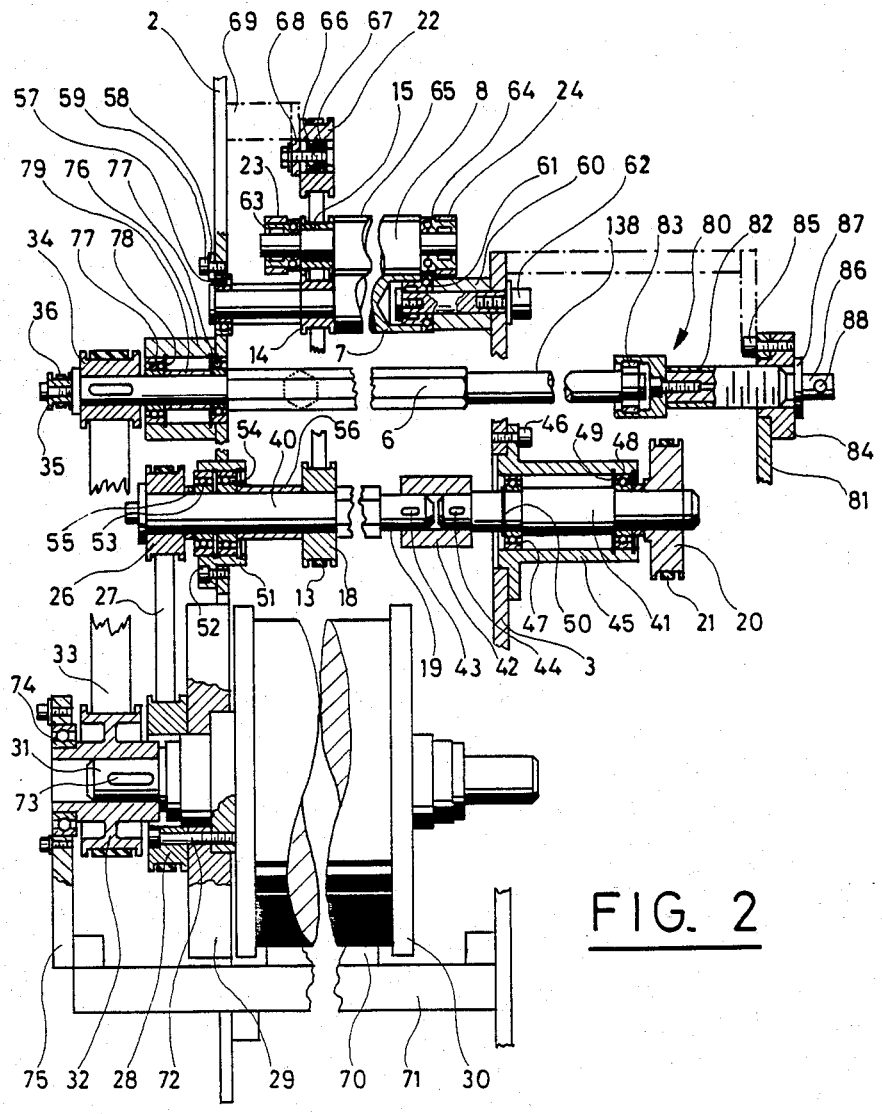
FIG. 2 is a cross sectional view, with portions in elevation for purposes of illustration, taken along the lined II —II of FIG. 1.

The principles of the present invention are particularly useful when incorporated in an infeeding device, generally indicated at 1, which is used for infeeding blanks or sheets into a processing machine for further converting the sheets or blanks, such as a folder-gluer. As illustrated in FIGS. 1 and 2, the device 1 has side frames 2 and 3. The sheet infeed station or device includes a front stop 4 for retaining a pile of sheets or blanks (not shown) to be introduced, and is designed for joint operation with a view of feeding the sheets or blanks one at a time by means of a certain number of conveying units or belts 5, which are situated to extend side-by-side in a direction perpendicular or transverse to the direction of feed for the sheets, which is indicated by arrow 201 in FIG. 12. The infeed devices 5 are driven by a transverse arranged shaft 6 (FIG. 1), which has a drive portion with a hexagonal cross section. The sheets fed into the machine by the conveyor appliances or units 5 are then moved forward with more or less equal speed by a lower and upper infeed rollers 7 and 8 to lower and upper conveyors 9 and 10 of the processing machine, such as a folder and gluer. A photoelectric cell 11 is fitted on a support 12 in a position to detect the leading or front edge of a sheet prior to entering between the rollers 7 and 8. The photoelectric cell is located at a fixed distance form the front stop or gate 4 and is, thus, positioned between the stop 4 and a nipping point between the infeed rollers 7 and 8.

Figure 4:
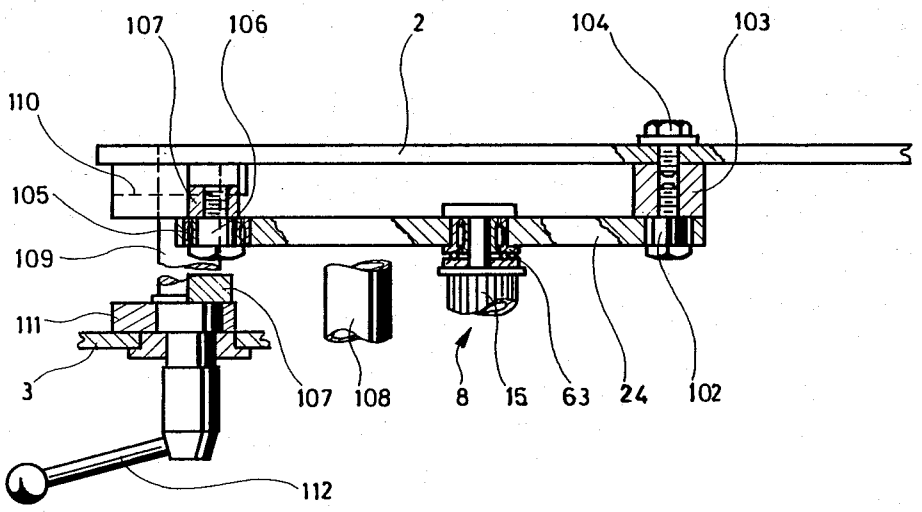
FIG. 4 is a partial cross sectional view, with portions in elevation for purposes of illustration, taken along the lines IV—IV of FIG. 1.
Figure 5:
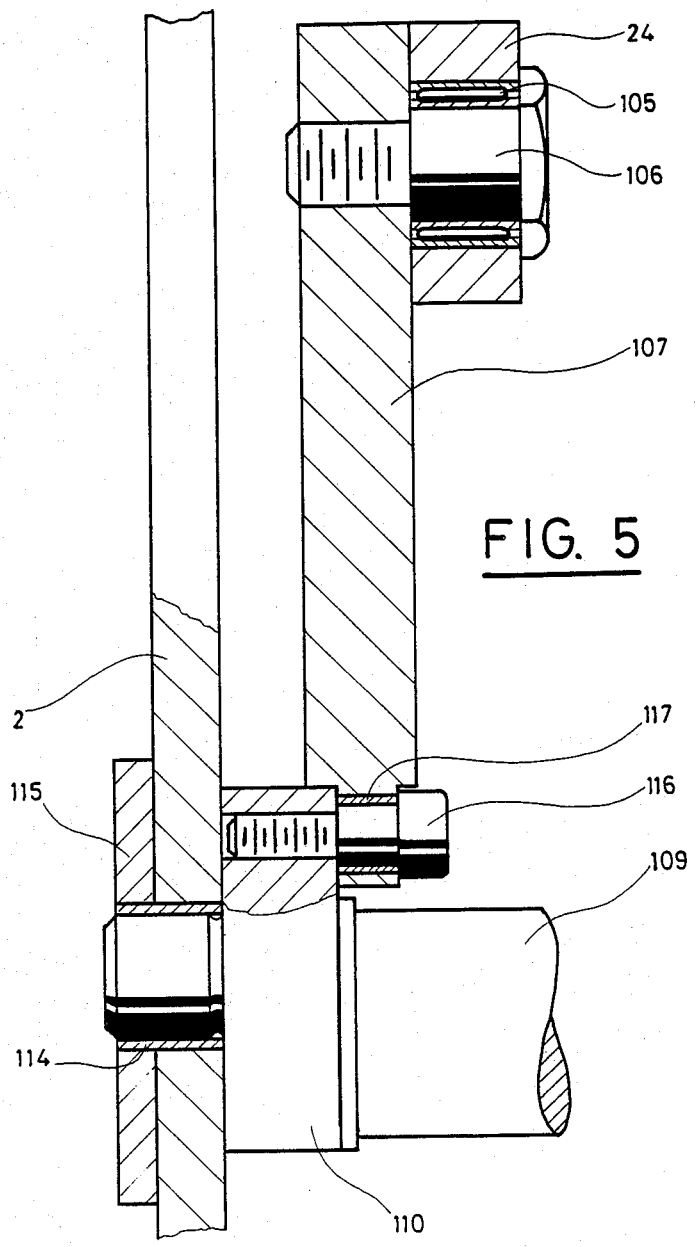
FIG. 5 is a cross sectional view, with portions in elevation for purposes of illustration, taken along the lines V—V of FIG. 1.

The drive of the infeed rollers 7 and 8 occurs by a double face tooth belt 13, which runs around a tooth pinion 14, and 15, which are attached to the ends of the shaft 16 and 17 for the infeed rollers 7 and 8, respectively. The belt 13 is driven in the following manner. A pulley 20 is secured on a shaft 19 and driven by a belt 21, which extends to the drive system or main drive (not illustrated) of the folder and gluer. The shaft 19 also supports a toothed pinion 18 (see FIG. 2), which drives the belt 13. The belt 13 also passes around a toothed pulley 22, which is part of an automatic tightener that maintains a steady tension on the belt 13. The upper feed roller 8 is supported for rotation between two pivoting levers 23 and 24, which can be pivoted by a setting appliance 25 to compensate for changes in the thickness of the sheets which are to be fed. The arrangement of the appliance 25 and the levers 23 are best illustrated in FIGS. 4 and 5.

Figure 3:
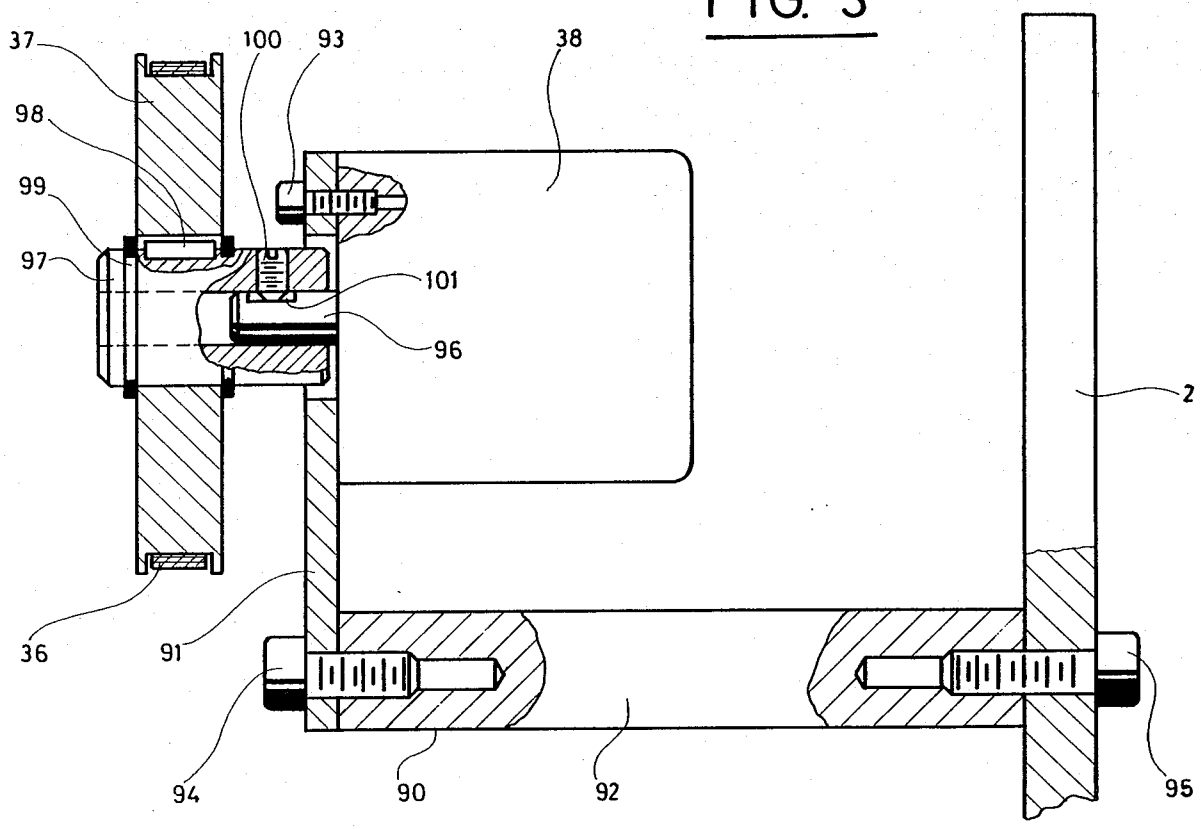
FIG. 3 is a cross sectional view, with portions in elevation for purposes of illustration, taken along the lines III —III of FIG. 1.

The cross shaft 6, which is part of the drive means for the conveyors, also obtains its drive from the main drive of the folder-gluer. In order to accomplish this, a toothed pinion 26 is mounted on the shaft 19 and is connected through a toothed belt 27 to a toothed wheel 28, which is secured by screws 72 on an inlet flywheel 29 (best illustrated in FIG. 2) of an electronic-pneumatic brake-and-clutch assembly 30. The clutch assembly 30 has an output shaft 31, which is provided with another toothed pulley or wheel 32 that is connected through a toothed belt 33 to a pinion 34 which is keyed on the end of the crosswise shaft 6. The end of the crosswise shaft 6 is also provided with a toothed pinion 35, which is connected by a toothed belt 36 to a toothed drive wheel 37 that is connected to a pulse generator 38, as best illustrated in FIG. 3. Each of the conveying appliances or units 5 can be laterally shifted and locked in the required position by means of a tightening device, generally indicated at 39, which will be described in greater detail with regard to FIGS. 6 and 7.

The drive shaft 19, as illustrated in FIG. 2, extends crosswise between the two side frames 2 and 3. The drive shaft 19 consists of two half-axles 40 and 41, which are connected together by means of a sleeve 42, which is provided with a groove designed to take up the keys 43 and 44 of the two half-axles 40 and 41. The half-axle 41 is held by a support 45, which is secured against the outside of the side frame 3 by means of screws 46. The support consists of two ball bearings 47 and 48, which are held by retaining rings 49 and 50. The half-axle 41 has the toothed pulley 20 at one of its ends. The other half-axle 40 is supported in the side frame member 2 by a support 51 which is secured on the outer surface of the frame 2 by screws 52.

As illustrated, the half-axle 40 carries the toothed pulley 18 and also the toothed pinion 26. The support 51 consists of two ball bearings 53 held by a retaining ring 54. The toothed pulley 18 and the toothed pinion 26 are keyed on the half-axle 40, and their lateral position is controlled by the bushings 55 and 56. The rotation of the shaft 19 is transmitted to both the infeed rollers 7 and 8 by the double-sided toothed belt 13 and to the brake-and-clutch assembly 30 by the toothed belt 27.

The lower infeed roller 7 is provided with a toothed pinion 14 and extends between the side frames 2 and 3. It is held within the side frame 2 by a ball bearing support 57, which is secured by a washer and screw combination 59. The other end of the lower infeed roller 7 engages a pivot 60, which is provided with a ball and roller thrust bearing 61. The pivot 60 is fitted against the inner surface of the side frame 3 by means of screws 62.

The upper infeed roller 8 is provided with a toothed pinion 15 and is supported at its ends within the pivoting levers 23 and 24 by ball and roller bearings 63 and 64. The upper infeed roller 8 is, preferably, coated with an elastomer coating 65 to increase its adhesion to the sheets or blanks.

The automatic tightener consists of a pulley 22, which is mounted on an axle 66 by a ball bearing 67, and the axle is mounted on a lever 68, which is mounted on a support 69, shown in dot-dash lines. The support 69 is secured on the inside of the frame 2.

The electro-pneumatic brake-and-clutch assembly 30 is held by a base plate 70 on a cradle 71, which is permanently secured between the side frames 2 and 3. The toothed wheel 28 is secured on the inlet flywheel 29 of the assembly 30 by means of screws 72. The toothed wheel 32 is on the ouput shaft 31, which is provided with a key 73. In addition, the wheel 32 has a hub which is supported by a ball bearing 74 on a support 75 of the cradle 71. The crosswise or transverse shaft 6 extends equally between the side frames 2 and 3 and its end, which has the toothed pinions 34 and 35, is supported within the side frame 2 by a support 76, which is composed of two ball bearings 77, which are held in place by two retaining rings 78 and a bushing 79. The support 76 is secured against the outer surface of the side frame 2 by means of screws. The shaft 6 has a drive portion, which has a hexagonal cross section and a cylindrical portion 138, which is a non-drive portion. The other end of the transverse shaft 6, which is adjacent the non-drive portion 168, is provided with a dismantling device 80, which is secured within a strap 81 that, in turn, is held against the outer side of the side frame 3. This dismantling device 80 includes a threaded pipe 82 equipped with a thrust and roller bearing arrangement 83, which receives the end of the cross or transverse shaft 6. The threaded part of the threaded pipe 82 is engaged in a nut 84, which is secured by means of screws 85 within the strap 81. The threaded end of the threaded pipe is extended by a cylindrical piece 86, which has a retaining ring 87 and a cylindrical pin 88 on which a crankshaft (not illustrated) can be engaged.

As best illustrated in FIG. 3, the pulse generator 38, which can be a standard type of pulse generator, is secured by screws 93 onto a strap or front plate 91 of a support which is secured onto a side frame 2. As illustrated, the front plate 91 is attached to a pad 92 by means of screws 94, and the pad is secured by screws 95 on the outer side of the side plate 2. An axle 96 of the pulse generator 38 is equipped with a sleeve 97, on which the toothed drive wheel 38 is held by a key 98 and by retaining rings 99. The sleeve 97 is secured on the axle by a set screw 100, which acts on a flat space 101 provided on the axle 96.

As mentioned hereinabove, the ends of the upper infeed roller 8 are supported on levers 24 and 25. As best illustrated in FIGS. 4 and 5, the lever 24 is mounted on one of the side frames 2, while the lever 25 is mounted in a similar manner (not illustrated) on the side frame 3. The lever 24 is mounted to pivot on its one end around a stud 102, which is threaded into a block 103, which, in turn, is held on the inside of the side frame 2 by means of a screw 104. At the other end, the lever 24 has a roller support 105 holding a stud 106, which is screwed into a pull rod 107. For purposes of clarification, the upper conveyor 10 of the machine is shown by its shaft 108. The vertical movement of the pull rod 107 is obtained by rotating a transverse shaft 109, which, as illustrated in FIGS. 4 and 5, has a disk 110 and 111, which are mounted in an eccentric fashion on the shaft 109. The pull rods are connected to the disk in an eccentric manner so that rotation of the shaft by means of a handle 112 (FIG. 4) will cause a reciprocation of the shafts 107. The shaft 109 can be locked in any position by means of a locking appliance 113 of the setting device 25 (see FIG. 1).

As best illustrated in FIG. 5, the shaft 109 rotates within a bushing 114, which is mounted in a support 115 which is, in turn, secured on the side frame 2. The disk 110 is connected eccentrically to a pull rod 107 by means of the screw 116, which extends through a bushing 117, which is located in the lower part of the connecting rod 107. The disk 111, at the other end of the shaft 109, is connected to the other rod 107 in a similar manner. Thus, rotation of the rod 109 will pivot the levers 24 and 25 about their pivot point to change the spacing between the roller 8 and 7.

Figure 6:
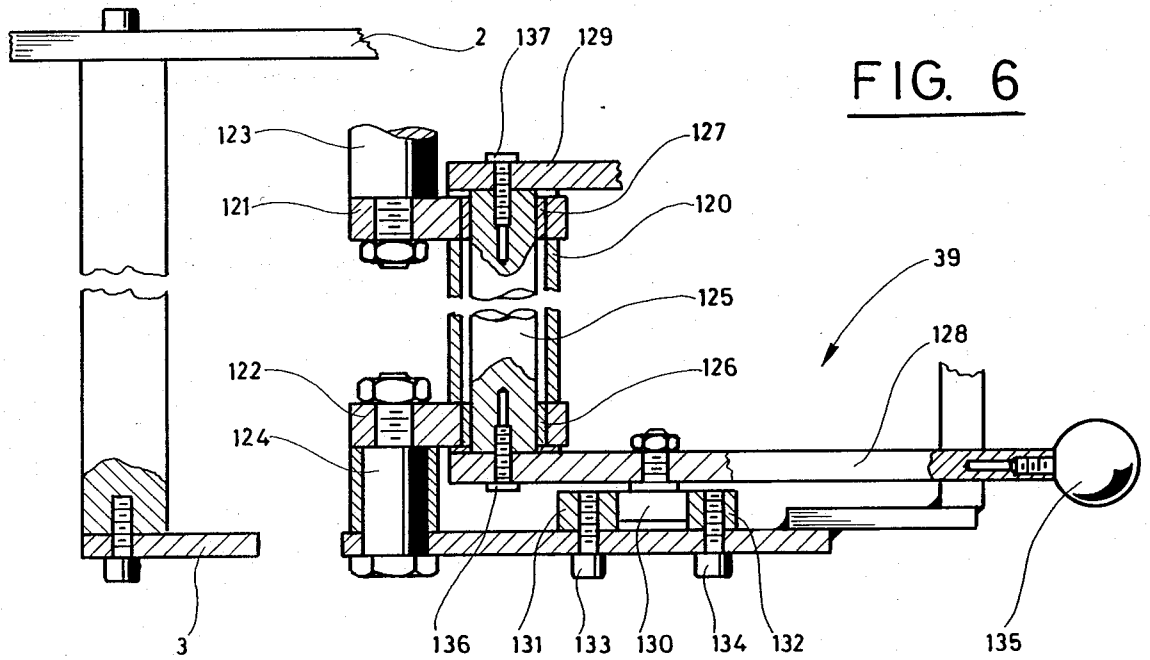
FIG. 6 is a cross sectional view, with portions in elevation for purposes of illustration, taken along the lines VI —VI of FIG. 1.
Figure 7:
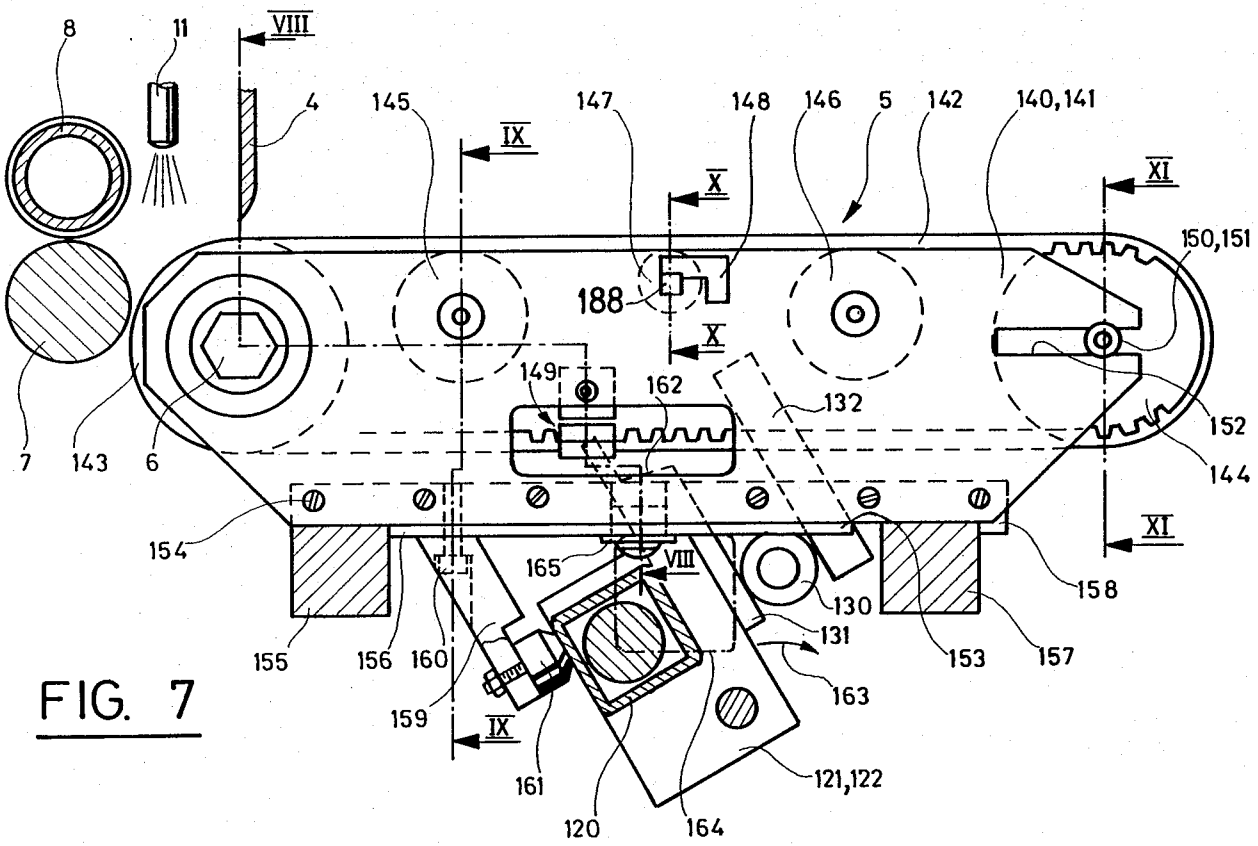
FIG. 7 is a side view, with portions broken away for purposes of illustration of the sheet conveyor unit in accordance with the present invention.

The tightening device or clamping means for securing each of the appliances or unit 5 in a given axial position along the drive shaft 6, is best illustrated in FIGS. 6 and 7. This device includes a square pipe 120, the ends of which are welded onto two plates 121 and 122, which are fitted on two pivots 123 and 124, which, in turn, are located on the side frames 2 and 3, respectively. The square pipe 120 contains a cylindrical shaft 125, which is secured within bushings 126 and 127. Both ends of the cylindrical shaft 125 are equipped with levers 128 and 129, respectively, and each of these levers holds a roller, such as 130, which is designed to engage within a linear cam formed by two sliding pieces 131 and 132, which are secured against the inner side of both side frames 2 and 3 by means of screws 133 and 134. In the Figure, only the linear cam and the cam follower of the side frame 3 have been illustrated, but the cams and followers on the other side are connected to the side frame 2 would be the same and are symmetrical. Only the end of lever 128 is equipped with the handle 135. The connection between the lever 128 and 129 and the cylindrical shaft 125 is achieved by means of screws 136 and 137.

Construction of the conveying device or unit is best illustrated in FIG. 7. Several of these devices or units 5 can be put side-by-side, as required by a job to be processed. One of the ends of the cross shaft 6 is arranged in such a way as to provide the cylindrical non-driving portion 138 (see FIG. 2), on which the conveying unit 5 can be put if they are to be placed out of operation temporarily. On account of the difference of the shape existing between the cylindrical part 138 and the hexagonal drive portions or part of the cross shaft 6, any conveyor unit placed in the area of the cylindrical part 138 will not be driven.

Figure 8:
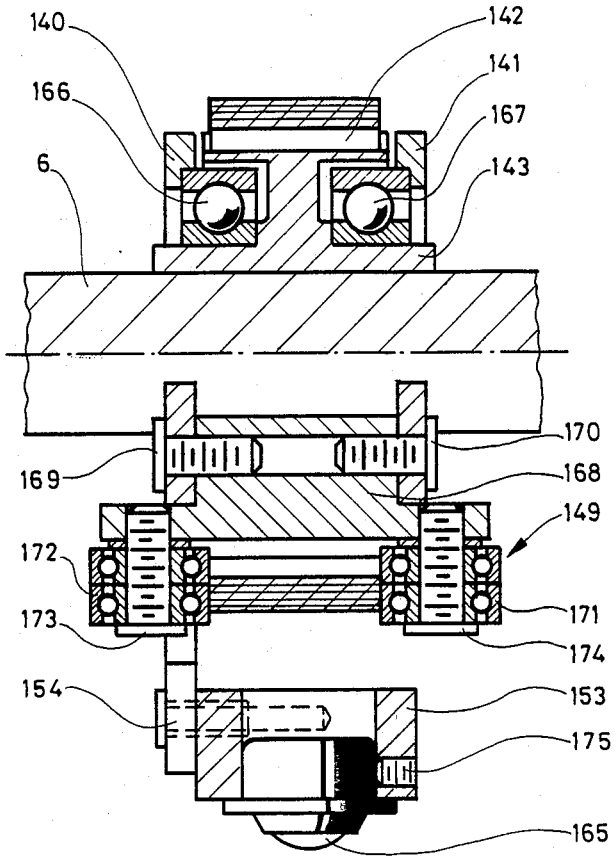
FIG. 8 is a cross sectional view, with portions in elevation for purposes of illustration, taken along the lines VIII—VIII of FIG. 7.

The conveying unit 5, as shown in FIGS. 7 and 8, has two side plates or guides 140 and 141 between which are mounted a toothed belt 142 running around a toothed drive pulley 143 and also around a toothed tightening pulley 144. In the course of its travel along the upper track, the toothed belt 142 is held by two toothed supporting pulleys 145 and 146, as well as by a smooth, vibratory pulley 147, which confers vibrations to the toothed belt 142 each time the belt's teeth run over the circumferential roller 147. The vibratory roller 147 can be moved in and out of operation by shifting it into a countersinking space 148, which is formed by a U-shaped slot on both side guides 140 and 141. The toothed belt 142 is guided laterally by means of roller devices 149, which are best illustrated and described in FIG. 8. The toothed tightening pulley 144 is held in a position by tightening screws 150 and 151, which extend through grooves 152 made in both side guides 140 and 141.

Figure 11:
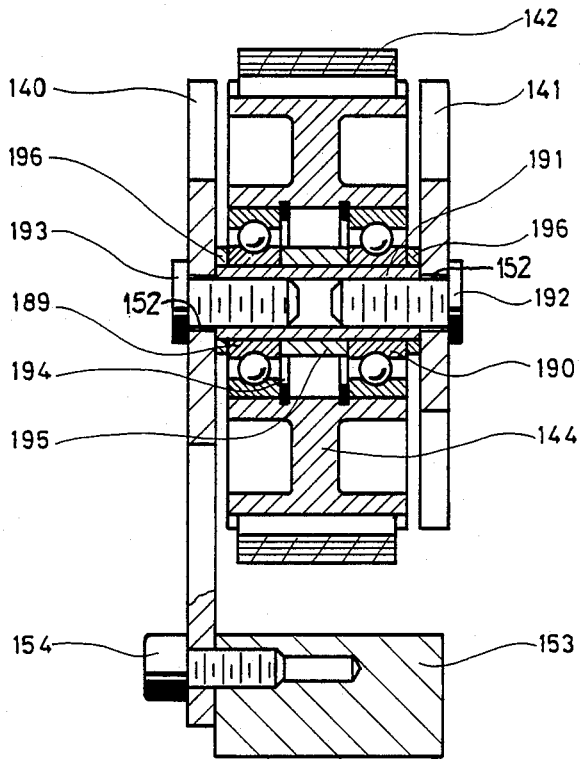
FIG. 11 is a cross sectional view, with portions in elevation for purposes of illustration, taken along the lines XI —XI of FIG. 7.

The side guide 140, on its lower part, has a supporting pad 153, which is attached to the inside of the guide by screws 154 (best shown in FIG. 11). This supporting pad 153 has a front shoulder 156 and is adapted to press against a crossbar 155 with the shoulder engaging the crossbar. In a rear section, the supporting pad 153 has a rear shoulder 158 and is adapted to rest on a rear crossbar 157, with the shoulder 158 engaging a portion of the crossbar 157.

Figure 9:
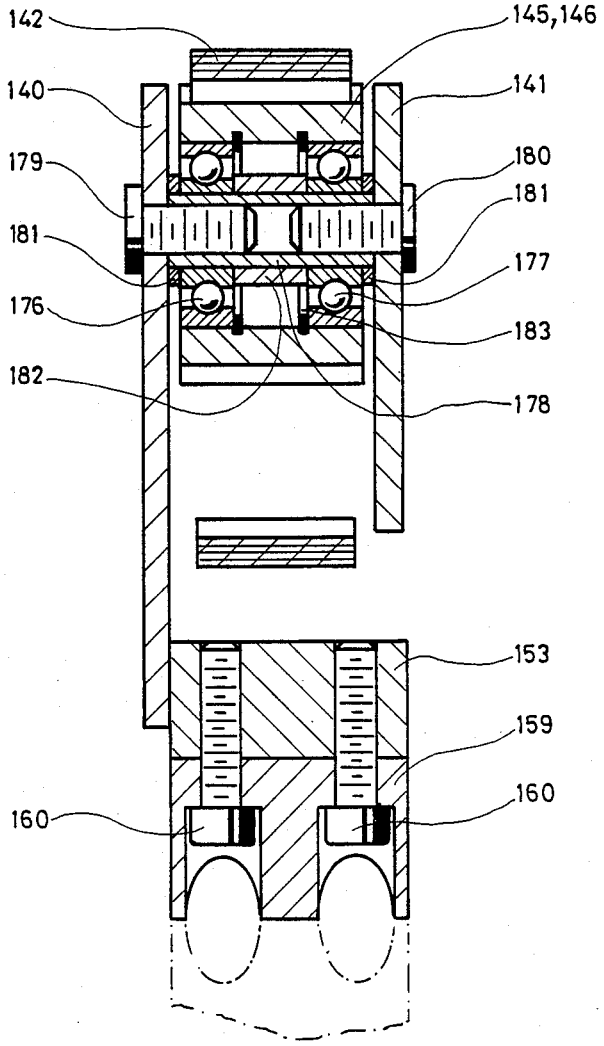
FIG. 9 is a cross sectional view, with portions in elevation for purposes of illustration, taken along the lines IX —IX of FIG. 7.

The support pad 153 has a downwardly extending member or stop 159, which is secured by screws 160 (best illustrated in FIG. 9). This member or stop 159 includes a bumper 161 of hard rubber. When the lever 128 (FIGS. 1 and 6) is actuated in order to have the roller 130 move into the position it occupies, as illustrated in FIG. 7, a tightening action will take place between the square pipe 120 and the bumper 161 due to the movement of the roller 130 within the linear cam. This is due to the geometric arrangement between the levers and the plates 121 and 122, which actually cause the supporting pad 153 and its shoulders 156 and 158 to be clamped against the crossbars 155 and 157, respectively. A motion of the levers 128 in the opposite direction to that illustrated in FIG. 1 will cause the rollers 130 to move into the space 162 of the sliding piece 132, whereby the plate 121 and 122 are caused to pivot in the direction shown by the arrow 163. The square pipe 120 will then occupy the position 164, which is shown in dot-dash lines, and this action will result in relieving the pressure holding the support pad 153 against the crossbars 155 and 157. The square pipe 120 will also lift the conveyor units 5 so that it will rest both on the cross shaft 6 and a ball 165, which is mounted in the supporting pad 153 and will be in contact with one of the sides of the square pipe 120.

As best illustrated in FIG. 8, the drive pulley 143 is secured on the cross shaft 6 and is held between the side guides 140 and 141 by two ball bearings 166 and 167. The side guides 140 and 141 are connected together and secured to a tie 168 by means of screws 169 and 170. The roller device 149 consists of ball bearing pairs 171 and 172 and are mounted on the lower side of the tie 168 by means of screws 173 and 174. The side guide 141 has a lesser height than the side guide 140, and this allows for an easy dismantling of the toothed belt 142 after its slackened and after the actuation of the dismantling device 80 of the cross shaft 6 has occurred. The pressing ball 165, which is mounted in the pad 153, as illustrated, is secured in a bore and is held in place by a set screw 175.

As best illustrated in FIG. 9, the supporting pulley 145 is mounted by two ball bearings 176 and 177 on a bushing 178. The side guides 140 and 141 are held tightly against the ends of the bushing 178 by screws 179 and 180. The lateral position of the ball bearings 176 and 177 is obtained by bushings 181 and 182. The mounting of the other supporting pulley 146 is exactly the same as that illustrated in FIG. 9 for the mounting of the pulley 145. FIG. 9 also illustrates the connection of the lever or member 159 by screws 160 to the supporting pad 153 and also illustrates that the side guide 141 has a lesser height than the guide 140.

Figure 10:
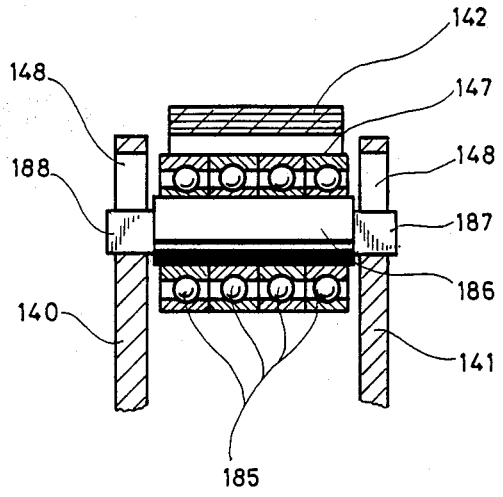
FIG. 10 is a cross sectional view, with portions in elevation, taken along the lines X—X of FIG. 7.

In FIG. 10, the vibratory roller 147 is illustrated as consisting of four ball bearings 185, which are arranged side-by-side on an axle 186, which has ends 187 and 188, which have a square cross section, as best illustrated in FIG. 7. The ends 187 and 188 are engaged in grooves or slots 148 which are cut or formed in the side guides 140 and 141. As illustrated in FIG. 7, the slots 148 have a U-shape, with one leg longer than the other so that by being positioned, as illustrated in FIG. 7, in the short leg, the roller is engaging the belt 142. However, if moved laterally to the other long leg of the U-shaped slot, then the roller will be moved to a position out of engagement with the bottom surface of the belt.

As mentioned earlier, the roller 144 is adjustable in the side guides or members 140 and 141. As best illustrated in FIG. 11, the roller 144 is mounted by two ball bearings 189 and 190 on a bushing or sleeve 191. The sleeve 191 is clamped between the two side guides 140 and 141 by screws 192 and 193, which extend through the slots 152. To position the ball bearings 189 and 190 on the sleeve 191, a bushing 195 and a pair of washers 196 are provided.

Figure 12:
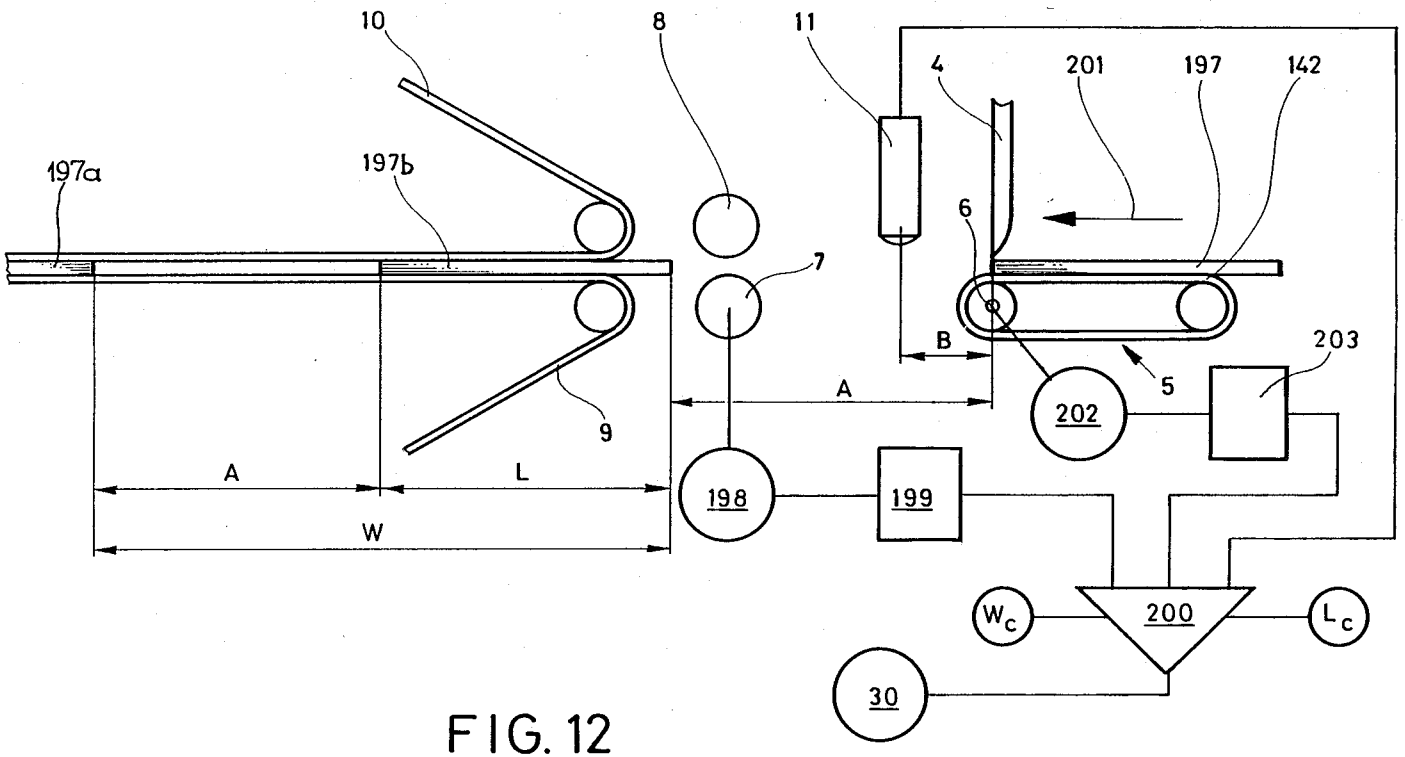
FIG. 12 is a schematic illustration showing the control circuit for the device of the present invention.

As mentioned hereinabove, one of the features of the present invention is the fact that the device can be adjusted to handle sheets or blanks of different lengths, and the spacing between the blanks can be adjusted. As illustrated in FIG. 12, sheets, such as 197, are placed in a pile behind a gate or stop 4 and are fed by the conveying unit 5 from the bottom of the pile underneath the stop into the rolls 7 and 8, which then feed the blank or sheet between the upper conveyor 10 and the lower conveyor 9 of the processing device, such as a folder-gluer.

Before starting up the folder-gluer represented by the upper and lower conveyors, the operator is to put in a setting for a value Lc, which corresponds to a length L of the sheet to be fed, as well as a rate or value Wc, which corresponds to a distance W between the rear or trailing edge of two consecutive sheets, such as the sheets 197*a* and 197*b* FIG. 12. The spacing between the rear or trailing edge and the front or leading edge of the two consecutive sheets 197*a* and 197*b* is represented by the distance A. With the values Lc and Wc determined, the folder-gluer will be started up and a first pulse generator 198, which is illustrated as being associated with the roller 7, will create pulses to represent the angular rotation of the roller and transmit these pulses to a first counter 199. The counter 199 will then transmit its count to the computer or device 200. When the count corresponds or compares to the set value Wc, the computer will emit a control signal to the electro-pneumatic clutch-and-brake assembly 30, which will be switched on and, thus, cause the rotation of the transverse shaft 6. At this instance, a sheet 197 will be moved in a direction of the arrow 201 beneath the gate or stop 4. A second pulse generator 202, which is associated with the shaft 6, will transmit pulses to a second counter 203. The second counter transmits the recorded pulses to the computer 200, which, when the number of pulses is compared to the inserted value Lc, will emit a second control signal to the electro-pneumatic clutch-and-brake assembly 30 to switch it off and, thus, stop rotation of the transverse shaft 6 and, therefore, the feeding of blanks 197. When the blank 197 is moving past the stop 4 in the direction of arrow 201, it will interrupt a beam of light directed to the photo cell 11, which has been positioned a distance B corresponding to a determined number of pulses, which has been memorized by the computer 200. The computer will take this number into consideration when calculating the switching off command to be emitted for the clutch-and-brake assembly 30. The signal originating from the photo cell 11 is transmitted to the computer and coacts with the signal from the counter 203 for this off control signal. With the folder-gluer continuing to operate, the first pulse generator 128 will continue to emit pulses and a new feed cycle will begin, as soon as the number of pulses corresponding to the set value Wc is obtained. In this regard, it is possible to set various counters and inputs so that the blank 197 is engaged in the feed rollers 7 and 8 as the conveying unit 5 stops conveying so that there is no possibility of misallignment of the blank.

Although various minor modifications may be suggested by those versed in the art, it should be understood that I wish to embody within the scope of the patent granted hereon all such modifications as reasonably and properly come within the scope of my contribution to the art.

I claim:

1. In a device for feeding sheets into a processing machine, said device having a frame; means for mounting at least two conveyor units in the frame, each conveyor unit having an endless belt; and a front stop position relative to the conveyor units to hold a pile placed on the belts of the conveyor units, said conveyor units conveying the lowermost sheet in the pile underneath the front stop into feed means, the improvements comprising a single drive means for all of the belts of each of the conveyor units, the single drive means includes a transverse shaft having a drive portion for transferring rotation and a cylindrical portion, said drive portion being adapted to engage a toothed drive pulley of the unit to rotate the drive pulley and said cylindrical portion receiving the drive pulley when a unit is being disengaged from the drive means, said shaft having a toothed pinion connected through a toothed belt to a toothed wheel fastened to an outlet shaft of an electro-pneumatic clutch-and-brake assembly, said clutch assembly having an inlet flywheel equipped with a toothed wheel which is connected through a toothed belt to a toothed pinion on a second drive shaft rotated by a main drive of the processing machine, said feed means consisting of a lower infeed roller and an upper infeed roller, which are driven continuously by a double-faced toothed belt driven by a toothed pulley on said second drive shaft; means for sequentially operating said drive means for a given period of time; and said means for mounting the conveyor units adjustably mounting the conveyor units in selected lateral positions relative to the direction of movement of the belts.

2. In a device according to claim 1, which includes means for adjusting the spacing between the two infeed rollers, one of said two infeed rollers being mounted by two pivot arms on the frame of the device, a free end of each of the pivot arms being connected to pull rods, which are eccentrically mounted on a rotatable adjustable shaft, so that rotation of the adjustment shaft pivots the lever arms to change the spacing between the infeed rollers.

3. In a device for feeding sheets into a processing machine, said device having a frame; means for mounting at least two conveyor units in the frame, each conveyor unit having an endless belt; and a front stop position relative to the conveyor units to hold a pile placed on the belts of the conveyor units, said conveyor units conveying the lowermost sheet in the pile underneath the front stop into feed means, the improvements comprising a single drive means for all of the belts of each of the conveyor units, said drive means having a drive shaft being driven through a clutch means by a main drive of the processing machine; said device including infeed rollers being driven continuously by the main drive; means for sequentially operating said drive means for a given period of time, said means for sequentially operating the single drive means including a photo-cell determining a given amount of movement of a sheet by said conveyor unit and sending an output to a control unit, a first pulse generator associated with the infeed rollers, a first counter counting the pulses from the first pulse generator, said counter applying a number to the control unit, which compares this number to a fixed number to create a start signal for the switching on the clutch means to start driving the conveyor units, a second counter counting the pulses of the second pulse generator and applying them to the control unit which, after receiving the signal from the photoelectric cell, compares the count to a fixed value corresponding to the length of the sheet to create a stop signal at the fixed value to disengage the clutch means and stop the conveyor unit; and said means for mounting the conveyor units adjustably mounting the conveyor units in selected lateral positions relative to the direction of movement of the belts.

4. In a device for feeding sheets into a processing machine, said device having a frame with side frame members, means for mounting at least two conveyor units in the frame, each conveyor unit having an endless belt; and a front stop position relative to the conveyor unit to hold a pile placed on the belts of the conveyor unit, said conveyor unit conveying the lowermost sheet in the pile underneath the front stop into feed means, the improvements comprising a single drive means for all of the belts of each of the conveyor units; means for sequentially operating said drive means for a given period of time; and said means for mounting the conveyor units adjustably mounting the conveyor units in selected lateral positions relative to the direction of movement of the belts, said means for mounting including means for locking the conveyor units in any lateral position in the frame, said means for locking consisting of two levers having rollers guided between two linear cams, the levers having ends being connected by a cylindrical shaft arranged within a square pipe, the ends of said pipe being mounted on a pair of side plates, which are pivotally mounted on the side frame members of the device, said square pipe, when rotating, moving from a position for clamping a conveyor unit in the frame to a position releasing the conveyor unit for movement laterally in the frame.

* * * * *